US011236631B2

(12) United States Patent
Skertic et al.

(10) Patent No.: US 11,236,631 B2
(45) Date of Patent: Feb. 1, 2022

(54) MECHANICAL IRIS TIP CLEARANCE CONTROL

(71) Applicants: Rolls-Royce Corporation, Indianapolis, IN (US); Rolls-Royce North American Technologies Inc., Indianapolis, IN (US)

(72) Inventors: Richard Joseph Skertic, Carmel, IN (US); Joshua J. Gear, Plainfield, IN (US); John Joseph Costello, Indianapolis, IN (US); Geoffrey L. Gatton, Brownsburg, IN (US)

(73) Assignees: ROLLS-ROYCE NORTH AMERICAN TECHNOLOGIES INC., Indianapolis, IN (US); ROLLS-ROYCE CORPORATION, Indianapolis, IN (US)

( * ) Notice: Subject to any disclaimer, the term of this patent is extended or adjusted under 35 U.S.C. 154(b) by 157 days.

(21) Appl. No.: 16/195,336

(22) Filed: Nov. 19, 2018

(65) Prior Publication Data

US 2020/0157965 A1 May 21, 2020

(51) Int. Cl.

| | |
|---|---|
| ***F01D 11/20*** | (2006.01) |
| ***F01D 11/12*** | (2006.01) |
| *F01D 11/22* | (2006.01) |

(52) U.S. Cl.

CPC ..... *F01D 11/20* (2013.01); *F01D 11/122* (2013.01); *F01D 11/22* (2013.01)

(58) Field of Classification Search

CPC ..... F01D 11/20; F01D 11/22

See application file for complete search history.

(56) References Cited

U.S. PATENT DOCUMENTS

| | | | | |
|---|---|---|---|---|
| 3,085,398 | A * | 4/1963 | Ingleson | F01D 11/22 415/127 |
| 4,122,668 | A | 10/1978 | Chou et al. | |
| 4,157,011 | A | 6/1979 | Liddle | |
| 6,048,170 | A * | 4/2000 | Dodd | F01D 11/005 415/135 |
| 6,113,349 | A * | 9/2000 | Bagepalli | F01D 11/08 415/135 |
| 6,126,390 | A | 10/2000 | Böck | |
| 6,497,634 | B1 | 12/2002 | Bode et al. | |
| 8,177,501 | B2 * | 5/2012 | Flanagan | F01D 11/18 415/208.2 |

(Continued)

FOREIGN PATENT DOCUMENTS

| | | |
|---|---|---|
| EP | 0 924 388 A2 | 6/1999 |
| WO | WO 2010/101948 | 9/2010 |

OTHER PUBLICATIONS

Systems of Commercial Turbofan Engines, Chapter 2: Engine Air Systems, Online ISBN: 978-3-540-73619-6, dated 2008, pp. 23-47, published by Springer, Berlin, Germany.

(Continued)

*Primary Examiner* — Justin D Seabe

(74) *Attorney, Agent, or Firm* — Crowell & Moring LLP

(57) ABSTRACT

Systems and methods are provided that use a tip clearance control apparatus comprising a mechanical iris, where the tip clearance control apparatus controls a distance between a tip of a blade and a ring of abradable material positioned in an adjustable opening of the mechanical iris.

18 Claims, 7 Drawing Sheets

(56) References Cited

U.S. PATENT DOCUMENTS

| | | | | |
|---|---|---|---|---|
| 8,496,443 | B2 * | 7/2013 | Campbell | F01D 5/147<br>416/248 |
| 8,834,106 | B2 * | 9/2014 | Luczak | F01D 11/12<br>415/173.3 |
| 9,028,205 | B2 * | 5/2015 | Harris | F01D 17/143<br>415/173.1 |
| 9,255,489 | B2 * | 2/2016 | DiTomasso | F01D 11/18 |
| 10,415,419 | B2 * | 9/2019 | Sun | F01D 11/22 |
| 2010/0172754 | A1 | 7/2010 | Flanagan | |
| 2015/0003958 | A1 | 1/2015 | Uskert | |
| 2015/0218959 | A1 * | 8/2015 | Barb | F01D 11/22<br>415/173.1 |

OTHER PUBLICATIONS

Scott B. Lattime et al., "Turbine Engine Clearance Control Systems: Current Practices and Future Directions," Available at URL http://gltrs.grc.nasa.gov, dated Sep. 2002, pp. 1-22, published by National Aeronautics and Space Administration, Glenn Research Center, Cleveland, Ohio.

M.A. Radomski et al., "CF6 High Pressure Compressor and Turbine Clearance Evaluations," Aircraft Engine Diagnostics, dated Jul. 1981, pp. 19-42, published by National Aeronautics and Space Administration, Lewis Research Center, Cleveland, Ohio.

Extended European Search Report, issued in EP Application No. 19205040.9, dated Apr. 22, 2020, pp. 1-7, European Patent Office, Munich, Germany.

* cited by examiner

MECHANICAL IRIS TIP CLEARANCE CONTROL

TECHNICAL FIELD

This disclosure relates to control systems and, in particular, to tip clearance control systems.

BACKGROUND

Present tip clearance control systems suffer from a variety of drawbacks, limitations, and disadvantages. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

One purpose of tip clearance control is to achieve better specific fuel consumption for a gas turbine engine. Typical tip clearance control systems in either the compressor or turbine stages of the gas turbine engine may use cooling air piped in from other engine stations. This piping of air affects the thermal expansion and contraction of the engine shroud to control the tip clearance. However, the piping of cooling air from other engine stations results in a loss of engine efficiency and worse specific fuel consumption.

In one example, a tip clearance control apparatus may be provided that includes a mechanical iris having an adjustable opening, a ring positioned in the adjustable opening of the mechanical iris, the ring defining an aperture. Blades of a turbine or a compressor of a gas turbine engine may be positioned in the aperture of the ring. The ring comprises abradable material. A distance between a tip of any of the blades and an inner surface of the ring is adjustable based on a size of the adjustable opening of the mechanical iris.

In another example, a system for tip clearance control is provided that includes a mechanical iris and a ring comprising abradable material. The ring encircles a volume in which blades are configured to rotate. The mechanical iris may have an adjustable opening that encircles the ring. The distance between a tip of any of the blades and an inner surface of the ring is adjustable by a size of the adjustable opening of the mechanical iris.

In yet another example, a method for controlling tip clearance is provided. A tip clearance is determined. The tip clearance may be indicative of a distance between a tip of a blade of a gas turbine engine and an inner surface of a ring. The blade is configured to rotate within the inner ring. The ring is positioned in an adjustable opening of a mechanical iris. The tip clearance is adjusted by adjusting a diameter of the adjustable opening of the mechanical iris.

Systems and methods are described herein that use a mechanical iris for tip clearance control. The mechanical iris tip clearance control system may be used in an aircraft, for example, in compressor sections or turbine sections of gas turbine engines. Real-time control of tip clearance allows for improvements in idle and transient conditions. Alternatively, or in addition, because the systems and methods disclosed below do not require the transfer of bleed or bypass air, the gas turbine engine may experience more efficient specific fuel consumption than systems that use bleed or bypass air.

Figure 1:
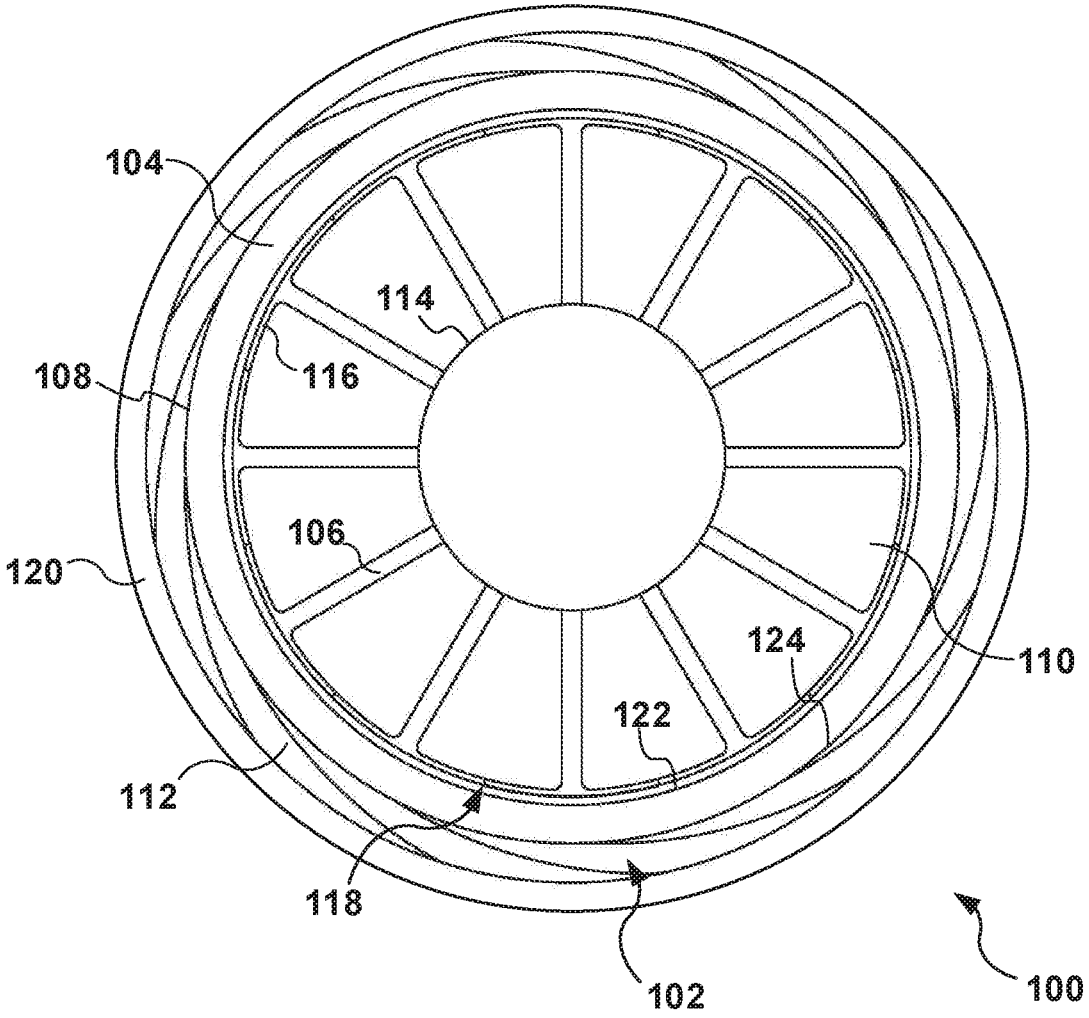
FIG. 1 illustrates a cross-sectional view of a mechanical iris tip clearance control system.

FIG. 1 illustrates a first example of a system 100 for tip clearance control. The example of the system 100 in FIG. 1 includes a mechanical iris 102, a ring 104 of abradable material, and a blade 106 or blades of a gas turbine engine. The mechanical iris 102 includes an adjustable opening 108. The ring 104 of abradable material includes an aperture 110 and is positioned in the adjustable opening 108 of the mechanical iris 102. The blade 106 of the gas turbine engine is positioned in the aperture 110 of the ring 104 of abradable material.

The mechanical iris 102 may be any mechanical apparatus having an opening whose diameter is mechanically adjustable, such as the adjustable opening 108 shown in FIG. 1. The mechanical iris 102 may include any number of iris leaves 112 configured to adjust the size of the adjustable opening 108 of the mechanical iris 102. In some examples, the mechanical iris 102 may be any mechanical apparatus that includes an iris ring 120 on which each leaf in the set of iris leaves 112 is coupled at a corresponding pivot point on the iris ring 120, and where the adjustable opening 108 increases or decreases in diameter as the iris leaves 112 pivot at the pivot points.

The iris leaves 112 may be any number of identically shaped, overlapping blades. In one example, as shown in FIG. 1, the iris leaves 112 are coupled together and are arranged in a circular pattern. As the number of iris leaves 112 included in the mechanical iris 102 increases, the adjustable opening 108 better approximates a circle. The iris leaves 112 of the mechanical iris 102 are configured to slide over each other in a way which causes the size of the adjustable opening 108 to change.

The ring 104 of abradable material positioned within the adjustable opening 108 of the mechanical iris 102 may be one continuous cylindrical piece of an abradable material as shown in FIG. 1. The abradable material may be any material that, when contacted by a harder material in motion, is worn down, while the harder material remains intact. For example, in the system 100, the ring 104 of abradable material is configured to wear down when contacted by the blade 106 of the gas turbine engine without causing damage or wear to the blade 106. Examples of the abradable material may include ceramic matrix composite (CMC) material or any other suitable material. In some examples, the ring 104 may comprise a coating or a layer of the abradable material on a non-abradable material.

The ring 104 of abradable material includes an inner surface 122 and an outer surface 124. The inner surface 122 of the ring 104 of abradable material faces the blade 106, while the outer surface 124 of the ring 104 of abradable material faces the iris leaves 112 of the mechanical iris 102.

The blade 106 may be any blade or airfoil suitable for use in a gas turbine engine. As shown in FIG. 1, the system 100 includes multiple blades 106, each blade 106 having a first end fixed to a hub 114 and an oppositely disposed second end having a tip 116. The blades 106 are configured to rotate around a center of the hub 114. The blades 106 may comprise CMC material or any other suitable material with desirably low thermal expansion.

During operation of the system 100, the system 100 may control a tip clearance 118. The tip clearance 118 is indicative of a distance between the tip 116 of the blade 106 and the inner surface 122 of the ring 104 of abradable material. The tip clearance 118 may have a target range, for example 0.009 inches to 0.011 inches.

In response to parameters such as a throttle lever angle, a rotor speed, a hub temperature, a turbine inlet temperature and/or a sensed value of the tip clearance 118, the system 100 may determine if the tip clearance 118 is to be increased, to be decreased, or to stay the same. For example, if the system 100 determines that the tip clearance 118 is be decreased, then the system 100 may cause the iris leaves 112 of the mechanical iris 102 to slide over each other in order to decrease the diameter of the adjustable opening 108. As the diameter of the adjustable opening 108 of the mechanical iris 102 decreases, the iris leaves 112 press against the ring 104 of abradable material, causing the ring 104 of abradable material to microly crumple. As the ring 104 of abradable material crumples, the inner surface 122 of the ring 104 of abradable material moves closer to the tip 116 of the blades 106, resulting in a decrease of the tip clearance 118.

Alternatively, the system 100 may determine that the tip clearance 118 is to be decreased. In response to such a determination, the system 100 may cause the diameter of the adjustable opening 108 of the mechanical iris 102 to increase by causing the iris leaves 112 of the mechanical iris 102 to slide over each other. As the diameter of the adjustable opening 108 of the mechanical iris 102 increases, the ring 104 of abradable material thermally and/or kinetically expands, causing the ring 104 of abradable material to press against the iris leaves 112. As the ring 104 of abradable material expands, the inner surface 122 of the ring 104 of abradable material moves further away from the tip 116 of the blades 106, resulting in an increase of the tip clearance 118.

In some examples, the ring 104 of abradable material may be bonded to the iris leaves 112 of the mechanical iris 102. In such an example, the ring 104 of abradable material may shrink or expand as a result of being bonded to the mechanical iris leaves 112 of the mechanical iris 102 and the diameter of the adjustable opening 108 of the mechanical iris 102 shrinking or expanding.

Figure 2:
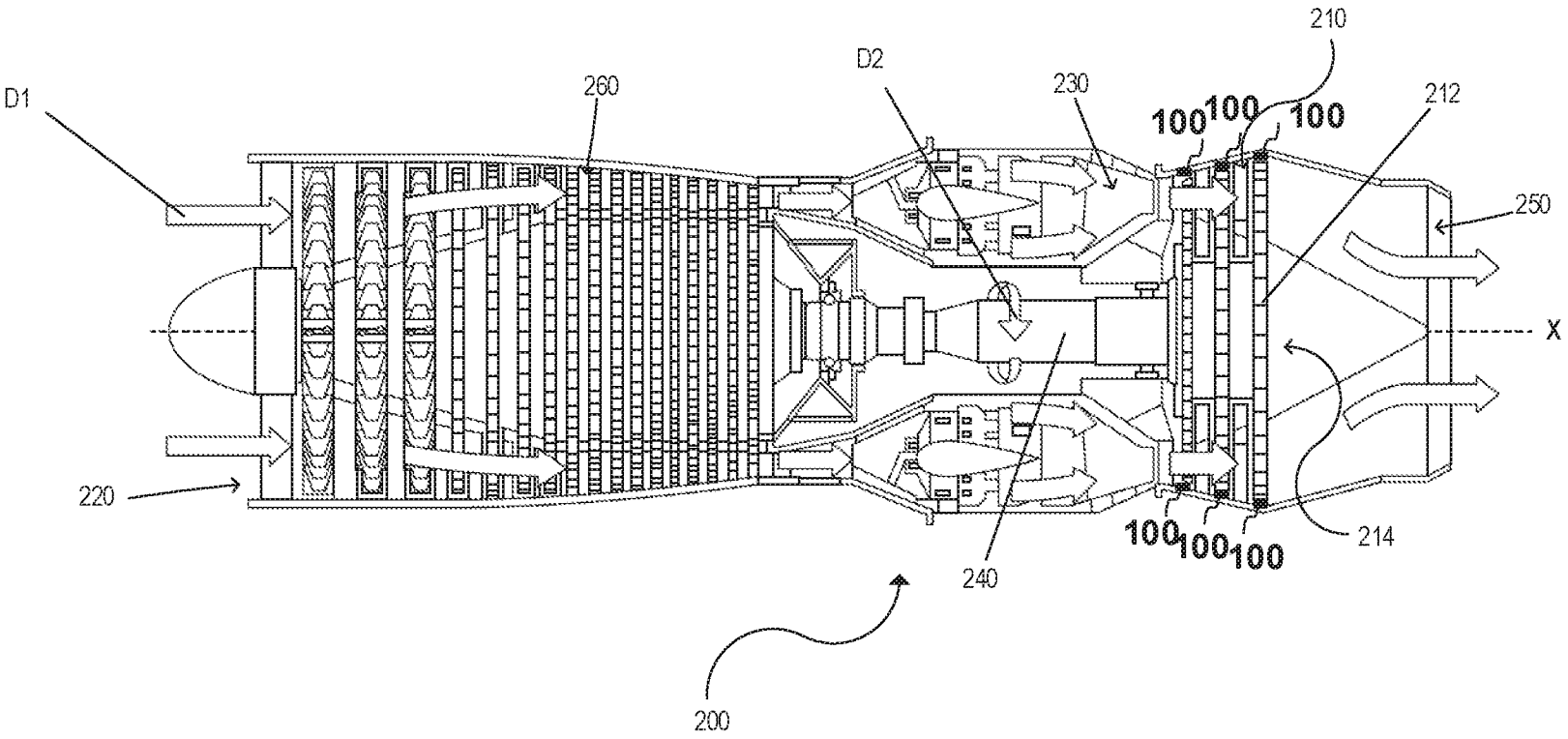
FIG. 2 illustrates a cross-sectional view of an example of a gas turbine engine.

FIG. 2 is a cross-sectional view of a gas turbine engine 200 in which an example of the system 100 is installed. The gas turbine engine 200 may supply power to and/or provide propulsion for an aircraft in some examples. Examples of the aircraft may include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne and/or extraterrestrial (spacecraft) vehicle. Alternatively or in addition, the gas turbine engine 200 may be utilized in a configuration unrelated to an aircraft such as, for example, an industrial application, an energy application, a power plant, a pumping set, a marine application (for example, for naval propulsion), a weapon system, a security system, a perimeter defense or security system.

The gas turbine engine 200 may take a variety of forms in various embodiments. Although depicted as an axial flow engine, in some forms, the gas turbine engine 200 may have multiple spools and/or may be a centrifugal or mixed centrifugal/axial flow engine. In some forms, the gas turbine engine 200 may be a turboprop, a turbofan, or a turboshaft engine. Furthermore, the gas turbine engine 200 may be an adaptive cycle and/or variable cycle engine. Other variations are also contemplated.

The gas turbine engine 200 may include an intake section 220, a compressor section 260, a combustion section 230, a turbine section 210, and an exhaust section 250. During operation of the gas turbine engine 200, fluid received from the intake section 220, such as air, travels along the direction D1 and may be compressed within the compressor section 260. The compressed fluid may then be mixed with fuel and the mixture may be burned in the combustion section 230. The combustion section 230 may include any suitable fuel injection and combustion mechanisms. The hot, high pressure fluid may then pass through the turbine section 210 to extract energy from the fluid and cause a turbine shaft of a turbine 214 in the turbine section 210 to rotate, which in turn drives the compressor section 260. Discharge fluid may exit the exhaust section 250.

As noted above, the hot, high pressure fluid passes through the turbine section 210 during operation of the gas turbine engine 200. As the fluid flows through the turbine section 210, the fluid passes between adjacent blades 212 of the turbine 214 causing the turbine 214 to rotate. The rotating turbine 214 may turn a shaft 240 in a rotational direction D2, for example. The blades 212 may rotate around an axis of rotation, which may correspond to a centerline X of the turbine 214 in some examples.

In order to achieve better specific fuel consumption for the gas turbine engine 200, the gas turbine engine 200 may include the tip clearance control system 100. The system 100 may be positioned in the compressor section 260 of the gas turbine engine 200 (as shown in FIG. 2) and/or the turbine section 210 of the gas turbine engine 200.

Figure 3:
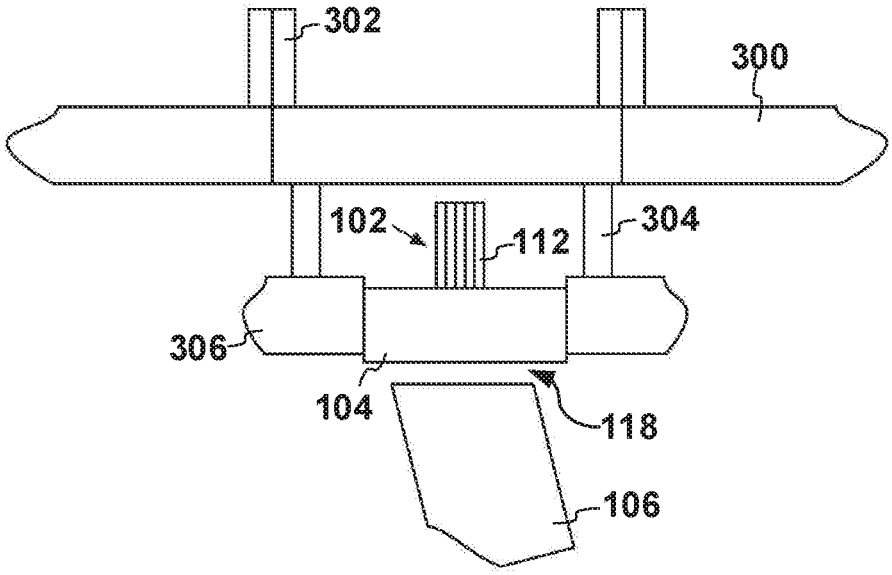
FIG. 3 illustrates another cross-sectional view of an example of the mechanical iris tip clearance control system positioned within a case of the gas turbine engine.

FIG. 3 illustrates a cross-sectional view of another example of the tip clearance control system 100 positioned within an engine case 300 of the gas turbine engine 200. The example of the system 100 shown in FIG. 3 includes the mechanical iris 102 having iris leaves 112, the ring 104 of abradable material, the blade 106, and a sensor 306 or sensors. The sensor 306 may be positioned adjacent to the ring 104 of abradable material.

The engine case 300 includes engine split lines 302 and stiffening flanges 304. The stiffening flanges 304 may position the system 100 within the engine case 300. The engine split lines 302 divide the engine case 300 into separate pieces. Each respective piece of the engine case 300 may contain its own system 100.

The sensor 306 may be any sensor capable of sensing the value of the tip clearance 118 in real time, such as an optical sensor, a microwave sensor, an eddy current sensor, and/or a capacitive sensor. The sensor 306 may be positioned adjacent to the ring 104 of abradable material upstream and/or downstream of the blades 106.

The direction of fluid flow is from left to right or right to left in FIG. 3. Accordingly, the blades 106 rotate in a plane that is perpendicular to the plane of the cross-section.

Figure 4B:
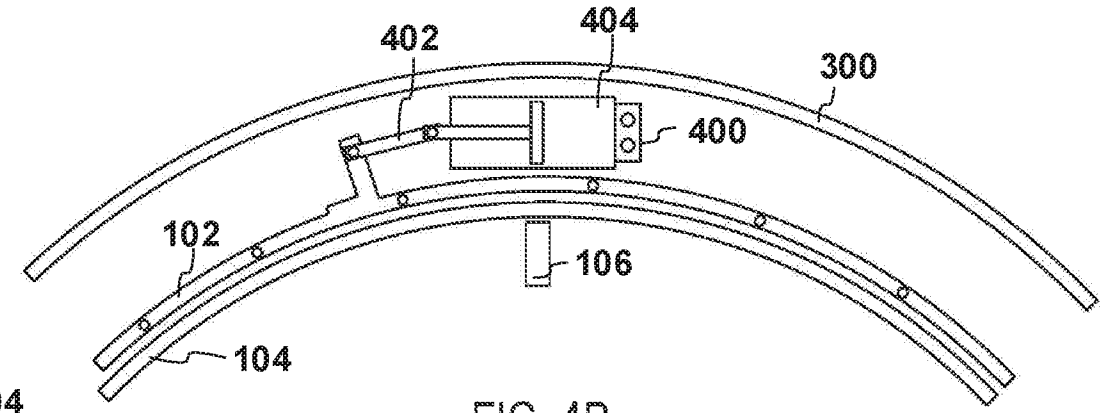
FIG. 4B illustrates another cross-sectional view of the mechanical tip clearance control system and the actuator of FIG. 4A.
Figure 4C:
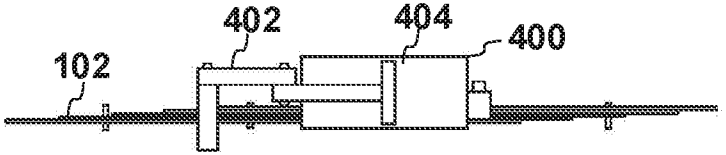
FIG. 4C illustrates another cross-sectional view of the mechanical tip clearance control system and the actuator of FIG. 4A.
Figure 4A:
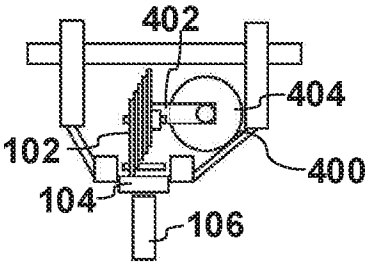
FIG. 4A illustrates a cross-sectional view of another example of the mechanical iris tip clearance control system, including an actuator.

FIGS. 4A, 4B, and 4C illustrate another example of the mechanical iris tip clearance control system 100 in which an actuator 400 is configured to cause the iris leaves 112 to move. FIG. 4A is a plan view of the system 100 viewed from a side of the gas turbine engine, where a flow path of the engine extends left to right through the blades 106. FIG. 4B is a cross-sectional view of the system 100 sliced through a plane that is perpendicular to the flow path. FIG. 4C is a plan view of the system from above, where the flow path extends from top to bottom of FIG. 4C. The actuator 400 is positioned within the engine case 300. The actuator 400 may be any mechanical device configured to cause the mechanical iris 102 to adjust. For example, the actuator 400 may be a complex actuator, a linear actuator, and/or a hydraulic actuator. The actuator 400 may be an electromechanical, a pneumatic, and/or an electromagnetic actuator. The actuator 400 may include an actuator arm 402 and an actuator body 404. The actuator arm 402 may be coupled to the actuator body 404 at one end of the actuator arm 402, and the actuator arm 402 may be coupled to the mechanical iris 102, the iris leaves 112, and/or the iris ring 120 at an oppositely disposed end of the actuator arm 402. The actuator 400 may be configured to receive control signals. The actuator 400 may be connected to the mechanical iris 102 via linkage, gears, or screw mechanism.

During operation, in response to received control signals, the actuator body 404 drives the actuator arm 402, and the actuator arm 402 causes the iris leaves 112 of the mechanical iris 102 to adjust. As detailed above, adjusting the mechanical iris 102 may cause the diameter of the adjustable opening 108 to increase or decrease.

Figure 5A:
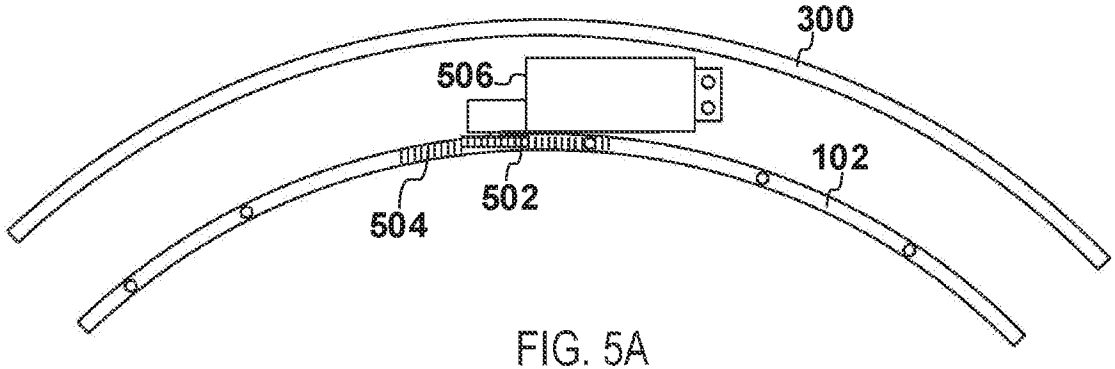
FIG. 5A illustrates a cross-sectional view of another example of the mechanical tip clearance control system, including a motor-driven actuator.
Figure 5B:
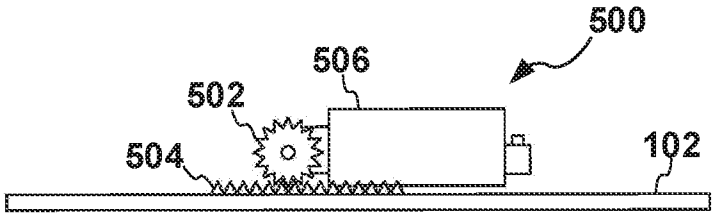
FIG. 5B illustrates another cross-sectional view of another example of the mechanical tip clearance control system and the motor-driven actuator of FIG. 5A.

FIGS. 5A and 5B illustrate cross-sectional views of another example of the mechanical tip clearance control system 100, including a motor-driven actuator 500 positioned within the engine case 300. The motor-driven actuator 500 may comprise any mechanical device with a pair of gears that convert rotational motion into linear motion. As shown in FIGS. 5A and 5B, the motor-driven actuator 500 may include a pinion 502 and a rack 504. The pinion 502 may be any circular gear having a plurality of teeth. The pinion 502 may be coupled to the motor-driven actuator body 506. The rack 504 may be any linear gear bar having teeth. The rack 504 may be coupled to one or more of the iris leaves 112, the iris ring 120, and/or the mechanical iris 102. The pinion 502 and the rack 504 may be positioned such that the teeth of the pinion 502 engage the teeth of the rack 504. The motor-driven actuator 500 may be configured to receive control signals.

During operation, in response to received control signals, the motor-driven actuator 500 may cause the pinion 502 to rotate. As the pinion 502 rotates in place, the teeth of the pinion 502 continue to engage the teeth of the rack 504, causing the rack 504 to move relative to the pinion 502. Depending on the direction of rotation of the pinion 502, the rack 504 causes the iris leaves 112 to slide over each other and either increase or decrease the diameter of the adjustable opening 108 of the mechanical iris 102.

Figure 6:
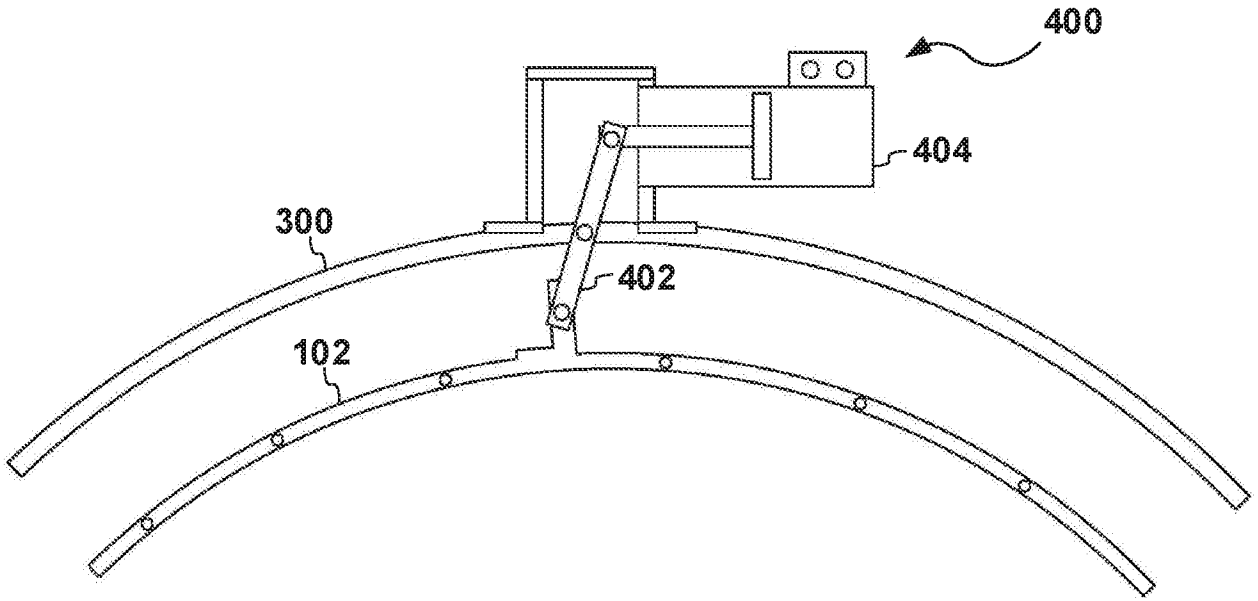
FIG. 6 illustrates a cross-sectional view of the mechanical tip clearance control system, including an externally-mounted actuation system.

In other examples, the actuator 400, the motor-drive actuator 500, and/or any other suitable actuator may be positioned outside of the engine case 300. In such an example, the actuator 400 may comprise more conventional materials than in examples where the actuator 400 is subjected to higher heat. In one example, as shown in FIG. 6, the actuator arm 402 may extend from outside the engine case 300 into the engine case 300 in order to engage the mechanical iris 102.

Figure 7:
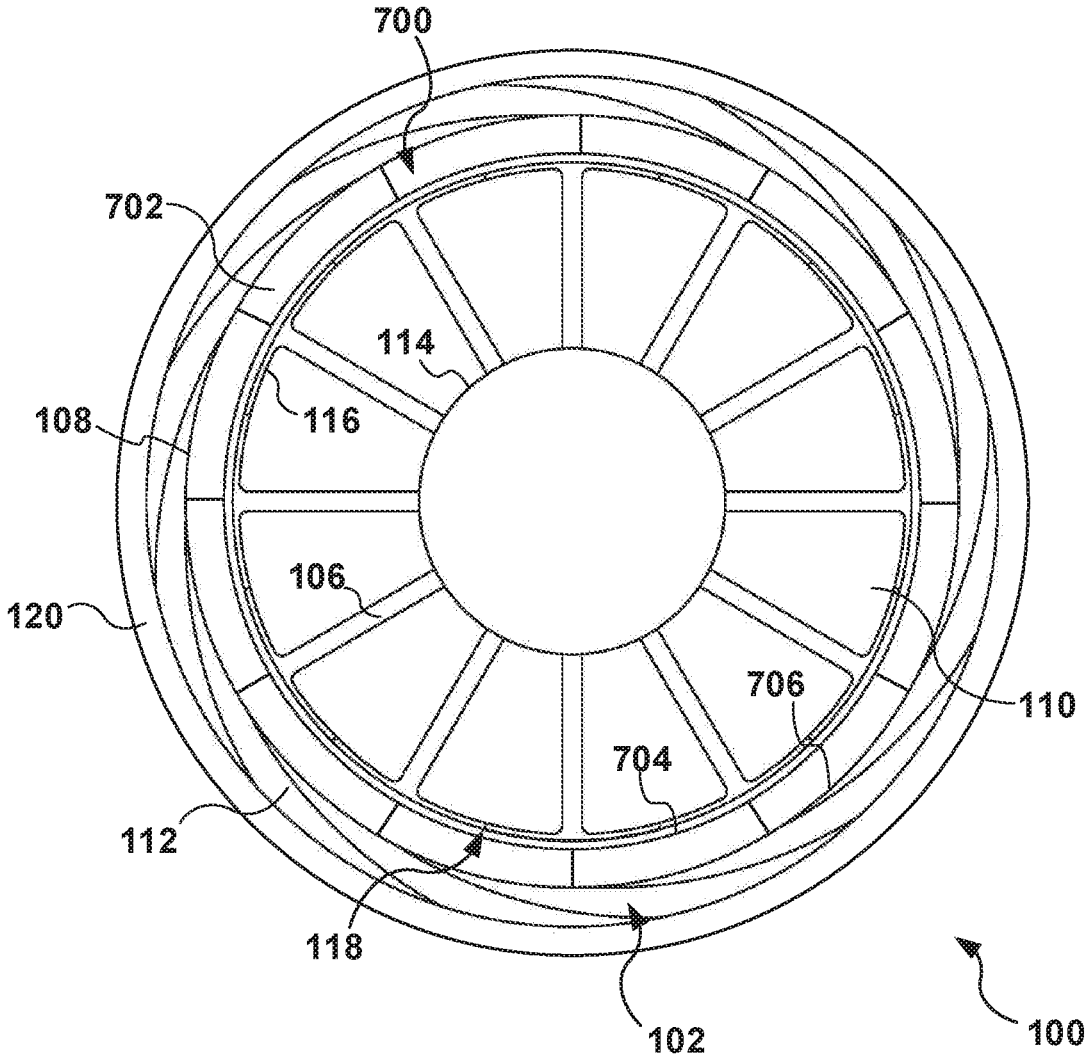
FIG. 7 illustrates another example of the mechanical tip clearance control system of FIG. 1, including a segmented ring of abradable material.

FIG. 7 illustrates another example of the mechanical tip clearance control system 100 of FIG. 1, wherein the ring 104 of abradable material comprises a segmented ring 700 of abradable material. The segmented ring 700 of abradable material includes a plurality of segments 702. An inner segmented surface 704 may be defined by one end of the segments 702, and an outer segmented surface 706 may be defined by an oppositely disposed end of the segments 702. Each segment 702 of the plurality of segments 702 of the segmented ring 700 of abradable material may contact at least one of the iris leaves 112. Alternatively, each segment 702 may be coupled or bonded to at least one corresponding one of the iris leaves 112.

During operation, for example, as the diameter of the adjustable opening 108 of the mechanical iris 102 decreases, the segments 702 of abradable material press against each other and cause each other to microly crumple. As the segments 702 of abradable material crumple, the inner segmented surface 704 of the segmented ring 700 of abradable material moves closer to the tip 116 of the blades 106, resulting in a decrease of the tip clearance 118.

As the diameter of the adjustable opening 108 of the mechanical iris 102 increases, the segments 702 may thermally and/or kinetically expand, causing the segments 702 of abradable material to press against each other and/or the iris leaves 112. As the segments 702 of the segmented ring 700 of abradable material expand, the inner segmented surface 704 of the segmented ring 700 of abradable material moves further away from the tip 116 of the blades 106, resulting in an increase of the tip clearance 118.

Each component of the system 100 may include additional, different, or fewer components. For example the mechanical iris 102 may include a cam plate to drive all of the iris leaves 112 simultaneously. The mechanical iris 102 may further include a spring portion that is configured to constantly expand the adjustable opening 108 of the mechanical iris 102. The spring portion may comprise any suitable spring-type metal.

The iris leaves 112 may comprise carbon fiber or metallic-based substrates. Alternate plating technologies, such as electrodeposited nanocrystalline metals sold under the trademark NANOVATE™, available from Integran Technologies Inc., may be used to plate the iris leaves 112 resulting in weight and cost reduction. In another example, the iris leaves 112 may be manufactured with additive layer manufacturing, potentially resulting in an increase in strength and a reduction in weight and cost.

The system 100 may be implemented with additional, different, or fewer components. For example, the system 100 may include a controller (not shown) configured to receive information from the sensors 306 and/or other systems related to the gas turbine engine 200. The sensors 306 may be configured to provide a real time measurement of the tip clearance 118 in order for the controller to control the tip clearance 118 more accurately and/or more responsively than might otherwise be possible. In order to further improve tip clearance control, the controller may be configured to use either model-based and/or real time engine control methodologies. To further facilitate use of the controller, for example, the system 100 may use real-time tip clearance sensor data to provide accurate clearance measurements over the complete operating range of the gas turbine engine 200.

When implementing the model-based control methodology, for example, the controller may further comprise a control loop. In order to hold an operating point and track and enable transient performance of the system 100, the control loop may calculate a target clearance from a series of controller parameters. The controller parameters may include, for example, the rotor speed, the hub temperature, a turbine inlet temperature, the throttle lever angle, and/or a sensed tip clearance.

During operation, for example, if the throttle lever angle increases, the control loop may determine a demand based on a preset target tip clearance and based on the change in throttle lever angle and/or the sensed tip clearance. The control loop communicates the demand to the controller, and the controller causes the mechanical iris 102 to adjust until a target tip clearance is achieved.

In the tip clearance control apparatus, the blade, the ring, and the mechanical iris may comprise a CMC material.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

What is claimed is:

1. A tip clearance control apparatus comprising:

a mechanical iris having a plurality of mechanical iris leaves, radially inward facing edges of the mechanical iris leaves form an adjustable opening which approximates a circle, wherein the mechanical iris leaves overlap and are stacked in a direction parallel to an axial axis of the mechanical iris, and wherein the mechanical iris leaves are configured to slide over each other in a plane perpendicular to the axial axis which causes a size of the adjustable opening to change;

a ring positioned in the adjustable opening of the mechanical iris, the ring defining an aperture; and a blade of a gas turbine engine, the blade positioned in the aperture of the ring, wherein the ring comprises abradable material, and wherein a distance between a tip of the blade and an inner surface of the ring is adjustable based on the size of the adjustable opening of the mechanical iris.

2. The tip clearance control apparatus of claim 1, wherein the blade and the ring comprise a CMC material.

3. The tip clearance control apparatus of claim 1, further comprising a sensor configured to detect the distance between the tip of the blade and the inner surface of the ring.

4. The tip clearance control apparatus of claim 1, wherein the abradable material is bonded to the mechanical iris leaves.

5. The tip clearance control apparatus of claim 1, wherein the ring comprises a plurality of segments.

6. The tip clearance control apparatus of claim 1, wherein the abradable material is configured to microly crumple.

7. A system for tip clearance control comprising:

a ring comprising abradable material, the ring encircling a volume in which a blade of a gas turbine engine is configured to rotate; and a mechanical iris having a plurality of mechanical iris leaves, radially inward facing edges of the mechanical iris leaves form an adjustable opening that encircles the ring, wherein the mechanical iris leaves overlap and are stacked in a direction parallel to an axial axis of the mechanical iris, and wherein the mechanical iris leaves are configured to slide over each other in a plane perpendicular to the axial axis which causes a size of the adjustable opening to change, and wherein a distance between a tip of the blade and an inner surface of the ring is adjustable by the size of the adjustable opening of the mechanical iris.

8. The system for tip clearance control of claim 7, wherein the blade is a compressor blade of the gas turbine engine.

9. The system for tip clearance control of claim 7, wherein the blade is a turbine blade of the gas turbine engine.

10. The system for tip clearance control of claim 7, wherein the mechanical iris further comprises a plurality of iris leaves coupled to a cam plate, and wherein the cam plate is configured to move the plurality of iris leaves in unison.

11. The system for tip clearance control of claim 7, further comprising an actuator coupled to the mechanical iris, the actuator configured to adjust a size of the adjustable opening of the mechanical iris.

12. The system for tip clearance control of claim 11, wherein the actuator comprises a motor-driven actuator.

13. The system for tip clearance control of claim 7, wherein the ring comprises an outer surface that abuts the mechanical iris.

14. A method for controlling tip clearance, the method comprising:

determining a tip clearance, the tip clearance indicative of a distance between a tip of a blade of a gas turbine engine and an inner surface of a ring within which the blade is configured to rotate, the ring positioned in an adjustable opening of a mechanical iris having a plurality of mechanical iris leaves, radially inward facing edges of the mechanical iris leaves form the adjustable opening which approximates a circle, wherein the mechanical iris leaves overlap and are stacked in a direction parallel to an axial axis of the mechanical iris, and wherein the mechanical iris leaves are configured to slide over each other in a plane perpendicular to the axial axis which causes a diameter of the adjustable opening to change; and adjusting the tip clearance by adjusting the diameter of the adjustable opening of the mechanical iris.

15. The method of claim 14, further comprising controlling an actuator coupled to the mechanical iris, the actuator causing the diameter of the adjustable opening of the mechanical iris to adjust.

16. The method of claim 15, wherein the actuator comprises a linear actuator, wherein the linear actuator is driven by a hydraulic mechanism.

17. The method of claim 14, wherein the tip clearance is within a range from 0.009 inches to 0.011 inches.

18. The method of claim 14, wherein an outer surface of the ring is bonded to a plurality of the mechanical iris leaves of the mechanical iris.

* * * * *